United States Patent [19]

Wheeler et al.

[11] 4,204,213

[45] May 20, 1980

[54] FLEXIBLE DIPOLE ANTENNA

[75] Inventors: Myron S. Wheeler, Catonsville; Stephen L. Creasy, Columbia, both of Md.

[73] Assignee: Westinghouse Electric Corp., Pittsburgh, Pa.

[21] Appl. No.: 933,930

[22] Filed: Aug. 15, 1978

[51] Int. Cl.[2] ..... H01Q 1/28

[52] U.S. Cl. ..... 343/706; 343/813; 343/814

[58] Field of Search ..... 343/700 MS, 705, 707, 343/708, 706, 813, 814, 824

[56] References Cited

U.S. PATENT DOCUMENTS

| | | | |
|---|---|---|---|
| 3,005,986 | 10/1961 | Reed | 343/708 |
| 3,273,062 | 9/1966 | Raabe | 343/706 |
| 4,071,846 | 1/1978 | Oltman | 343/700 MS |
| 4,074,270 | 2/1978 | Kaloi | 343/700 MS |

*Primary Examiner*—Eli Lieberman

*Attorney, Agent, or Firm*—D. Schron

[57] ABSTRACT

A flexible strap-like antenna which may be supported on the outside surface of an aerostat includes a first substrate member having conductors thereon in a pattern which includes a center conductor and dipole antennas on either side of the center conductor. A ground conductor is disposed over the center conductor and is electrically insulated from it by an insulating strip sandwiched between them. A second or covering substrate seals the layered arrangement.

To achieve broad band operation, an array of antennas is provided with the width of the center conductor being varied for certain different sections thereof.

15 Claims, 19 Drawing Figures

FIG. 1.
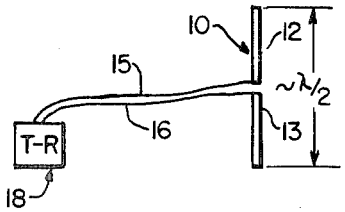
FIG. 2.
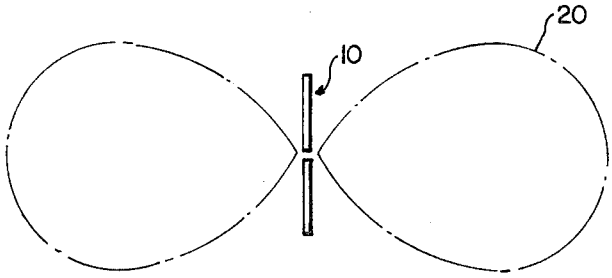
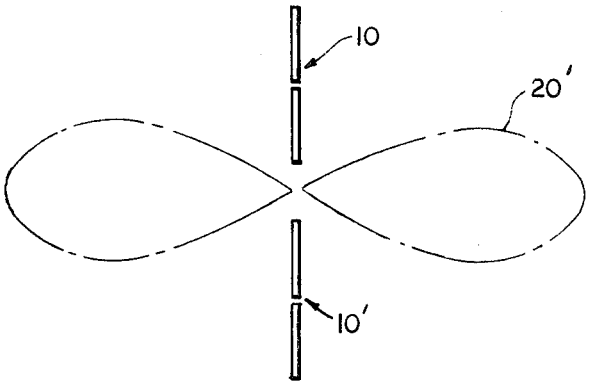
FIG. 3.
FIG. 4.
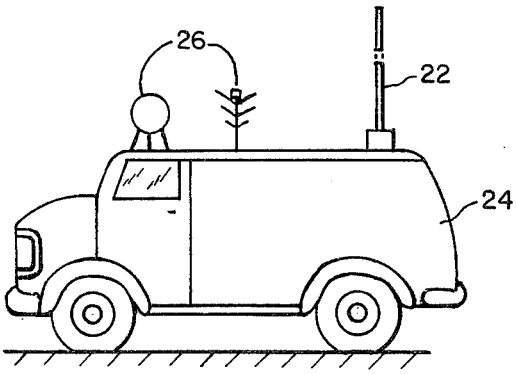

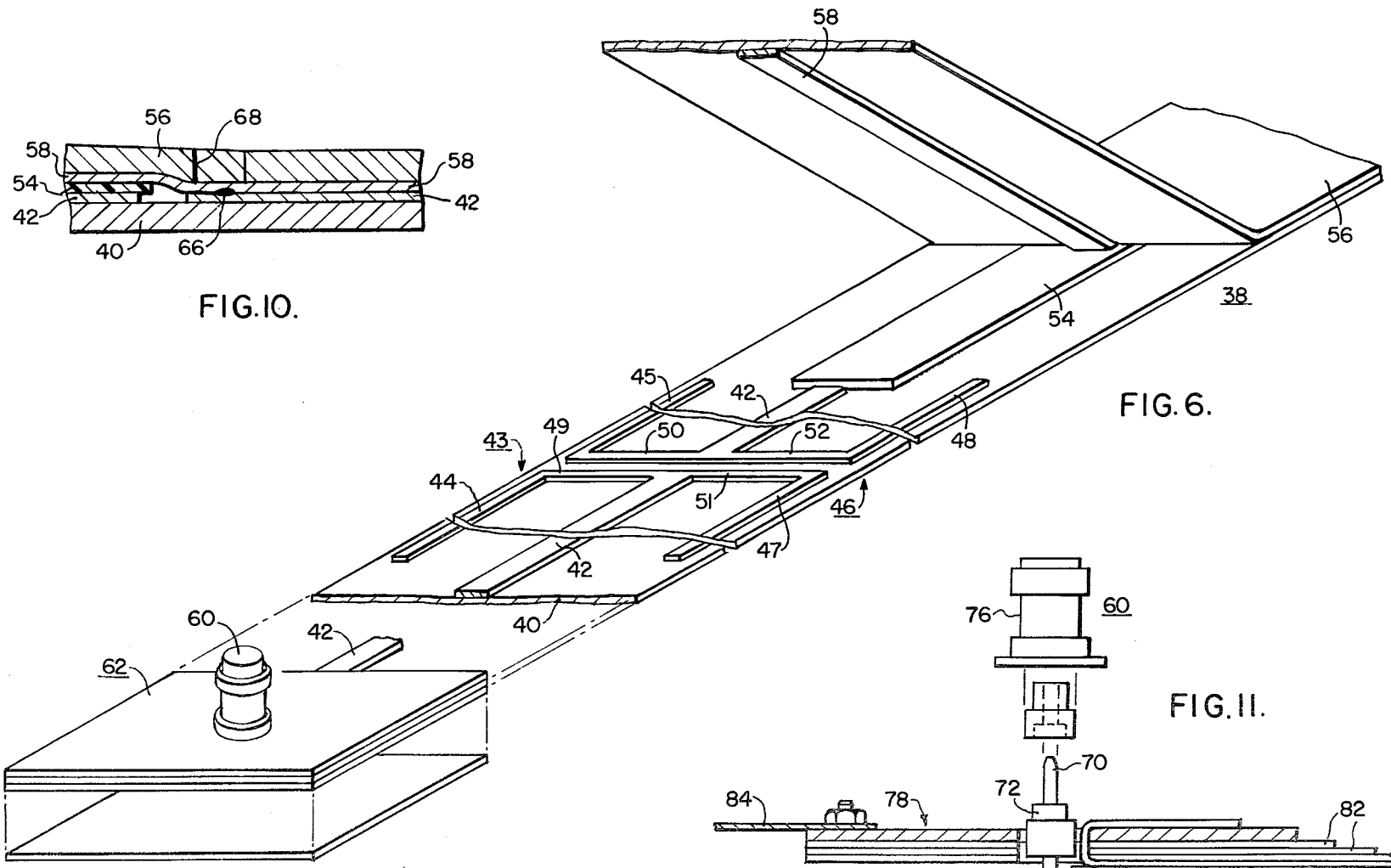
FIG. 6.
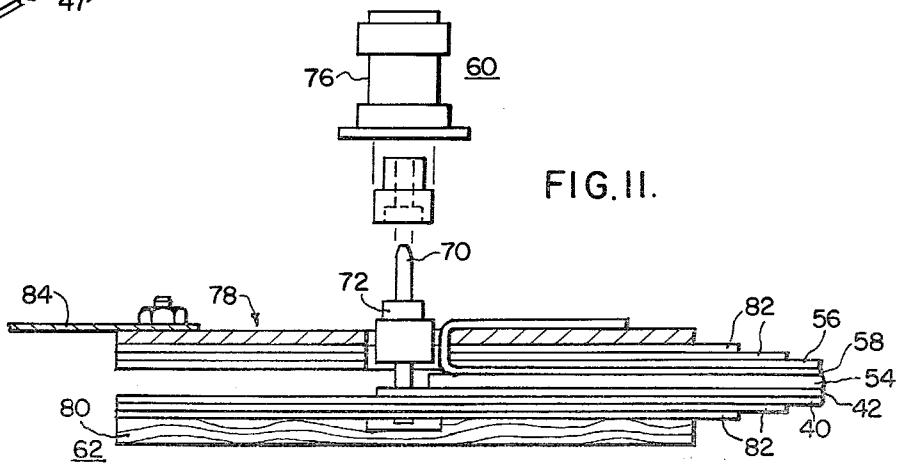
FIG. 11.
FIG. 10.

FLEXIBLE DIPOLE ANTENNA

BACKGROUND OF THE INVENTION

1. Field of the Invention

The invention in general relates to antenna structures, and more particularly to flexible omnidirectional dipole antenna arrangement.

2. Description of the Prior Art

The use of lighter-than-air vehicles as high altitude platforms for communication equipments has been known for many years. By suspending electronic payloads from a stabilized platform beneath an aerodynamically shaped balloon, called an aerostat, point-to-point and omni-directional communications can simultaneously be accommodated. The aerostat is generally tethered at an altitude of several thousand meters to provide ground area coverage of several hundred thousand square kilometers.

For each system the payload configuration depends upon the particular application and a typical payload might include commercial and educational TV, AM and FM radio broadcast equipment, off-the-air receivers, translating equipment, high and low density wide band communications equipment for fixed and mobile multichannel voice and data transmission, to name a few. The electronic systems utilize a variety of different antennas some of which may be mounted on the stabilized platform suspended from the aerostat, with the antennas, as well as the electronic equipment, being protected from the environment by an aerodynamically shaped windscreen.

For some applications such as mobile telephone communications, a relatively long rigid antenna is required for a base station and this presents a mounting problem. For such mobile telephone use where the aerostat is in effect the base station, the antenna must radiate and receive omnidirectionally, however, if the relatively long antenna is merely suspended beneath the wind screen to achieve omnidirectionality, it structurally interferes with the tether and is subject to wind loads.

The aerostat has an air-filled tail assembly the interior of which may serves as a protective mounting location for the rigid antenna. However, for many operations it would be desired to fill the tail assembly with helium to give added lift to the structure and the inclusion of the elongated rigid antenna in a helium atmosphere would be undesirable.

Another possible mounting location for the antenna would be on the outside surface of the areostat hull. However, there is an incompatibility due to the fact that a relatively long rigid member has to be firmly secured to a relatively soft flexing member and in addition to a mounting problem, there is the danger of tearing the fabric of the aerostat hull.

SUMMARY OF THE INVENTION

The present invention provides a solution to the mounting of a relatively long dipole antenna array in a system which is incompatible with a long rigid antenna arrangement.

A lightweight dipole antenna is provided which is flexible and strap-like in configuration. The antenna includes an elongated flexible substrate member with a layer of conductive material disposed over the substrate member in a certain pattern which includes a first centrally disposed conductor extending along the length of the substrate member, and first and second dipole antenna elements disposed on either side of the first conductor and connected to it. For added antenna gain, additional antenna elements may be added at predetermined distances along the length of the substrate member.

A flexible, electrically insulating layer is disposed over the first conductor. The sandwiching arrangement further includes a second flexible, covering layer and a second centrally disposed conductor extends along the covering layer and is positioned between it and the insulating layer. The first conductor is in electrical circuit with the second conductor and a connector assembly is provided for signal transfer with the antenna by connection to the first and second conductors.

BRIEF DESCRIPTION OF THE DRAWINGS

FIG. 1 shows a half wavelength dipole antenna;

FIG. 2 illustrates the radiation pattern of the antenna of FIG. 1;

FIG. 3 illustrates the modified radiation pattern resulting from utilizing a colinear array of two half wave dipoles;

FIG. 4 illustrates a communications center utilizing a plurality of antennas;

FIG. 6 is a view, with portions broken and peeled away, of one embodiment of the present invention;

FIG. 10 is a view along the line X—X of FIG. 9;

FIG. 11 is a cross-sectional view through the connector assembly utilized in FIG. 6;

DESCRIPTION OF THE PREFERRED EMBODIMENT

Figure 5B:
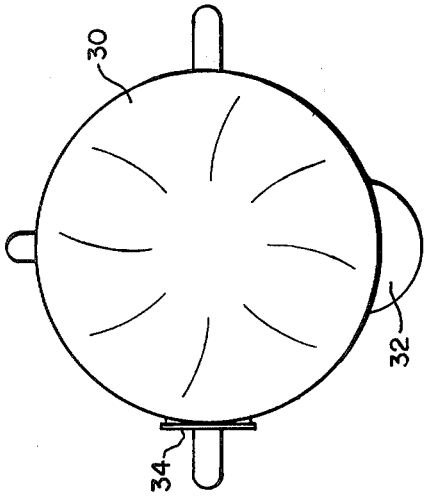
FIG. 5A is a side view and FIG. 5B a front view of a tethered aerostat.

Referring now to FIG. 1 there is illustrated a typical center-fed half wavelength dipole antenna 10 including dipole arms 12 and 13 connected by means of dipole feed leads 15 and 16 to transmitting and/or receiving equipment 18. As is well known, the half wavelength corresponds to a particular frequency, however, operation is generally over a band of frequencies with the wavelength of the center frequency in the band chosen for antenna design. In addition, the dipole antenna may not be exactly one half a wavelength of this center frequency but some portion of it, for example 90 percent or more.

In operation, the radiation pattern of the dipole antenna is as illustrated in FIG. 2 and for a vertical orientation of the dipole antenna the radiation 20 would be omnidirectional in a horizontal plane. In order to increase the antenna gain, one or more dipole antennas may be colinearly arranged with the dipole antenna such as depicted by the dipole antennas 10 and 10' of FIG. 3. The effect of the addition of another radiating element is to decrease the beam width of the antenna pattern, as depected at 20'.

Utilizing two colinear dipole antennas by way of an example, the antennas generally are packaged in a single stiff self-supporting unit such as unit 22 illustrated in FIG. 4. Antenna 22 is illustrated on a communications van 24 having a plurality of other antennas 26 such as for microwave and TV applications. For VHF and/or mobile telephone operations, the length of the antenna 22 may exceed 8 feet. In the environment illustrated in FIG. 4, the mounting of antenna 22 poses no problem. However, when this antenna is to be used in a tethered aerostat application, proper mounting becomes of prime importance not only for correct operation but for maintaining the integrity of the aerostat itself. For example, in FIGS. 5A and 5B there is illustrated an aerostat 30 (the tether is not shown) which carries electronic communications equipment on a stabilized platform which is covered by an aerodynamically shaped windscreen 32. Due to the proximity of the electronic equipment within the windscreen 32 and due to space limitations, the rigid dipole antenna 34 has to be securely mounted in another location. One such location is as illustrated on the side of the aerostat hull. Due to the incompatability between the rigid antenna and the flexible aerostat skin the mounting of the antenna at this location is somewhat less than desirable. In accordance with the present invention, the rigid antenna structure is replaced by a flexible strap-like antenna which performs the same function and which may be secured to the side of the aerostat hull and conform to its shape and flexibility. One such embodiment of this antenna is illustrated in FIGS. 6 through 11 to which reference is now made.

FIG. 6 illustrates a portion of the antenna with a top layer peeled away to reveal the sandwiched arrangement. For clarity, the thickness of the various layers has been exaggerated. The antenna includes a first flexible substrate member 40 having conductive material disposed over its surface in a certain pattern which includes a first centrally disposed conductor 42 and first and second dipole antenna elements 43 and 46 disposed on either side of the conductor 42. The dipole arms 44 and 45 of dipole 43 are connected to conductor 42 by means of respective dipole feeds 49 and 50 while dipole arms 47 and 48 of dipole 46 are connected to conductor 42 by means of dipole feeds 51 and 52.

Conductor 42 is covered by a flexible electrically insulating layer 54 and a flexible second substrate or covering layer 56 is provided and is coextensive with the first substrate member 40. A second centrally disposed conductor 58 is positioned between the electrically insulating layer 54 and the covering layer 56 and in essence forms a parallel plate transmission line with conductor 42.

A connector 60 of the coaxial variety is supported by a connector plate assembly 62 and is electrically connected with conductors 42 and 58 to be in signal transfer relationship with the antenna elements.

Figure 7:
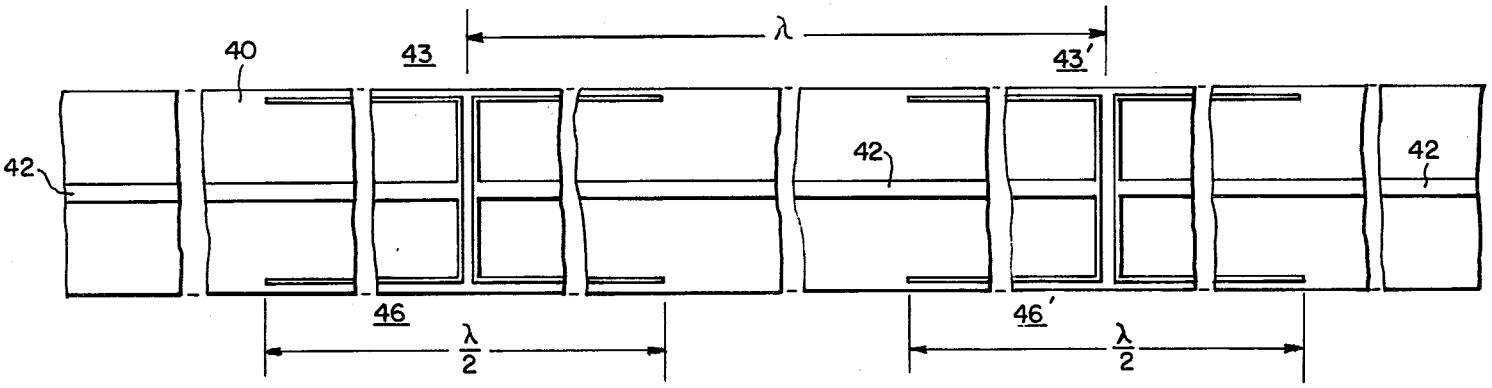
FIG. 7 is a view of the substrate layer of the antenna of FIG. 6.

If the antenna arrangement just included dipole antennas 43 and 46 disposed on either side of conductor 42, the resulting antenna would operate as the antenna of FIG. 1 with a beam pattern as illustrated in FIG. 2. However, as previously mentioned, in order to increase the gain of the antenna a colinear array of dipole antennas such as illustrated in FIG. 3 may be utilized. The equivalent antenna system to that illustrated in FIG. 3, is illustrated in FIG. 7 where for clarity only the first substrate member 40 and conductor pattern thereon is illustrated. The first and second dipole antenna elements 43 and 46 are those described in FIG. 6. A second dipole antenna arrangement including dipole antenna elements 43' and 46' identical to antenna elements 43 and 46 is disposed on the substrate at a distance approximately one wavelength (λ) from the first antenna pair. Dipole antennas 43 and 46 disposed on either side of conductor 42 form a radiating and/or receiving element, as does dipole antennas 43' and 46'.

Figure 8A:
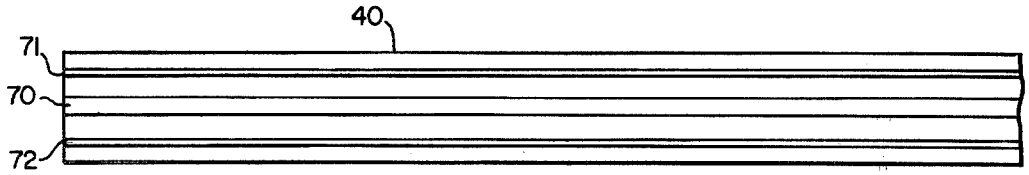
FIGS. 8A through 8C illustrate the fabrication of the substrate layer of FIG. 7
Figure 8B:
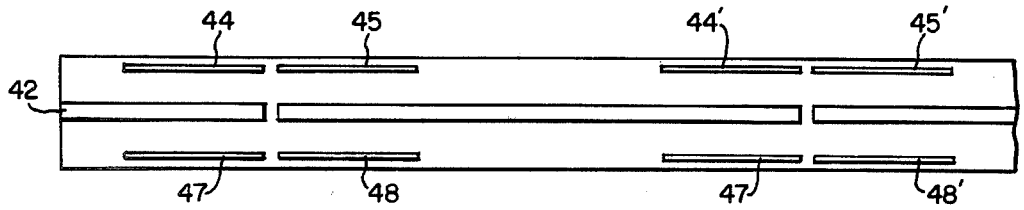
Figure 8C:
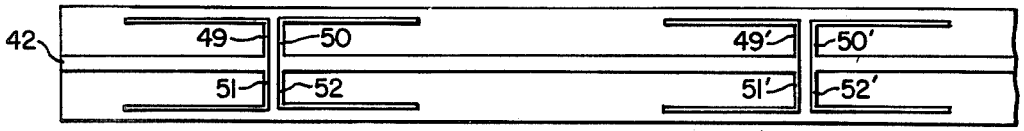

One method of fabricating the subassembly illustrated in FIG. 7 may be by the process such as illustrated in FIGS. 8A through 8C. In FIG. 8A the substrate 40 may be of a flexible material such as Mylar having a heat sensitive adhesive coating thereon and which has thin copper conducting members bonded thereto in the form of a central relatively wide flat conductor 70 and two relatively thin flat conductors 71 and 72 disposed on either side of the central conductor 70.

With a center operating frequency chosen, the value of λ is established and portions of the thin conductors 71 and 72 may be cut away leaving only the section such as illustrated in FIG. 8B and which sections form the dipole arms. Additionally, a small portion of the central conductor is cut away, as illustrated, forming the first conductor 42. Dipole feeds 49 to 52 and 49' to 52' connecting the central conductor with the dipole arms may be cut from the excess of strips 71 or 72 and soldered in place, as illustrated in FIG. 8C.

Figure 8D:
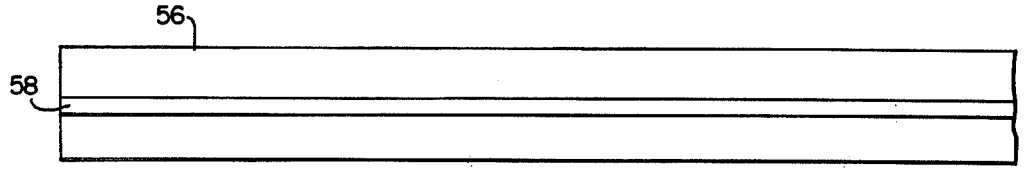
FIG. 8D illustrates a form of covering layer.

The electrical insulating layer 54 (FIG. 6) which may be in the form of an adhesively secured Teflon tape is laid over the conductor 42. As illustrated in FIG. 8D, a second substrate 56, which may be of flexible Mylar similar to substrate 40, has the second conductor 58 bonded thereto and this subassembly is added after the Teflon tape. Thereafter, heat is applied to secure the sandwiched arrangement. As an alternative, the structure illustrated in FIG. 8D may be formed from that illustrated in FIG. 8A merely by stripping away the outer conductors 71 and 72.

Figure 9:
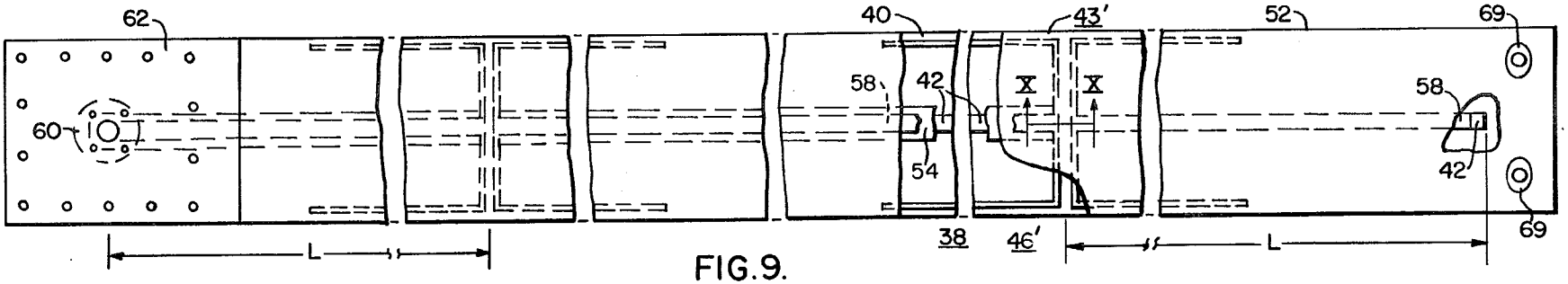
FIG. 9 is a plan view, with portions broken away, of the embodiment illustrated in FIG. 6.

A plan view of the completed structure is illustrated in FIG. 9 which has portions of the layers stripped away. The Teflon tape 54 extends from the connector 60 as the middle layer between the two conductors 42 and 58 and eventually terminates at the antenna pair 43'-46'. This is further illustrated in FIG. 10 which is a cross section along the line X—X of FIG. 9. In FIG. 10 it is seen that the Teflon tape 54 terminates at a point midway in the gap in conductor 42 and after which point conductors 42 and 58 are electrically joined together. To ensure for good electrical contact, conductors 42 and 58 may be soldered together as at 66 by application of heat to the solder joint through a hole 68 in substrate 56, after which process, the hole may be covered. Alternately, the soldering may be done by induction heating to avoid cutting the hole. As illustrated in FIG. 9, the conductor pair 58–42 extends past the antenna pair 43'-46'. The length L of this extension is approximately equal to the length L of the lead in from connector 60 to the first antenna pair 43–46 in order to achieve electrical balance.

Reinforced eyelets 69 are provided near the end of the strap-like configuration for mounting purposes, as will be seen.

Figure 12:
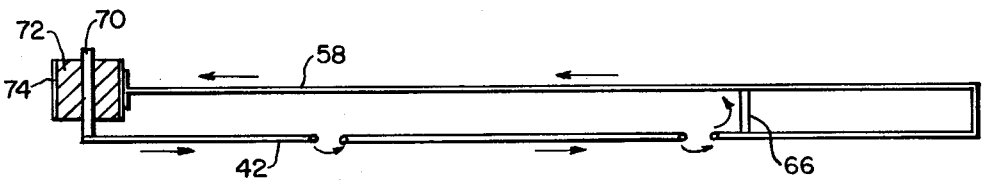
FIG. 12 is an electrical circuit diagram of the antenna of FIG. 6.

FIG. 11 is a cross-sectional view through the connector plate assembly 62. The coaxial connector 60 includes a center conductor 70, insulating spacer 72 and outer conductor assembly 76. The coaxial connector components are inserted through an aperture in metallic ground connector plate 78 and the flexible substrates of the elongated antenna are sandwiched between this connector plate 78 and a back plate 80. In order to strengthen the arrangement, a plurality of Mylar reinforcing layers 82 is included. From an electrical standpoint, first conductor 42 is electrically connected to center conductor 70 while the second conductor 58 is electrically connected to the ground plate 78/outer conductor assembly 76. A simplified electrical analogy of the connector and an antenna assembly is illustrated in FIG. 12 which additionally shows, by the plurality of arrows, current flow at a particular instant of time. Phase reversal of these arrows in $\lambda/2$ distances has not been shown to keep the illustrative concept simple.

Referring once again to FIG. 11, the plurality of layers is secured between the connector and back plates such as by screwing the plates together and a lacing lug 84 is affixed to the assembly for mounting purposes.

In accordance with the design and fabrication techniques described herein an antenna may be constructed consisting of either a single radiating element or a plurality of radiating elements to form an antenna array. As is well known, in order to achieve maximum energy transfer the impedance of the antenna arrangement should be closely matched to that of the transmitter/-receiver apparatus. The present design allows for the custom tailoring of antenna input impedance and also allows for a different impedance between sections of radiating elements.

Figure 13:
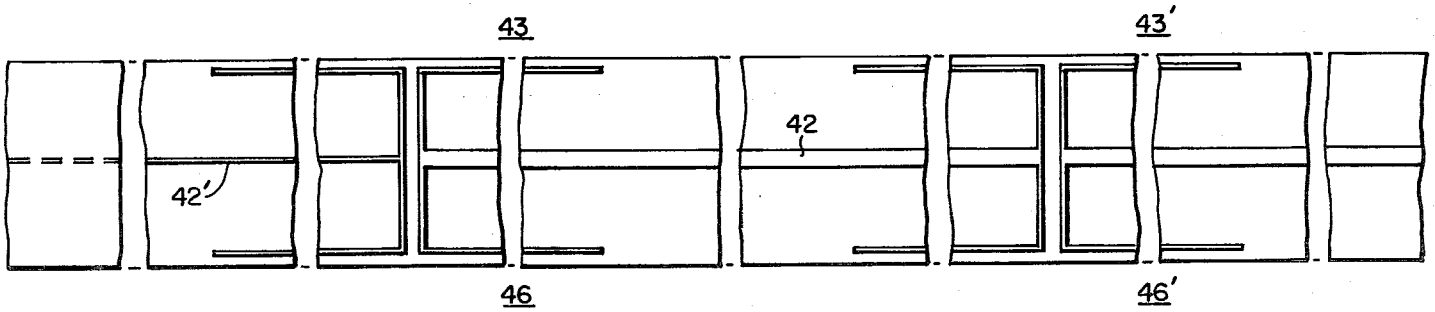
FIG. 13 is a view as in FIG. 7, illustrating an alternate construction.

One method by which the input impedance $Z_1$ may be custom tailored is by varying the thickness of the Teflon layer 54 between the parallel plate transmission line comprised of conductors 42 and 58. Another method by which the input impedance may be varied is by varying the width of the first conductor 42. This is illustrated in FIG. 13 which is similar to FIG. 7 however, with the first section of conductor 42 being of a smaller average width relative to the remainder of conductor 42. This first section is designated 42' in FIG. 13. Conductor 42 extending between radiating elements 43, 46 and 43', 46' is of a width which presents a different and lower impedance $Z_2$ which aids in providing for broad band operation. Although not illustrated in FIG. 13, an alternative for the custom tailoring of the impedances may be accomplished by varying the width of second conductor 58.

To provide for even further and more efficient impedance matching, the width of the input section of conductor 42 between the coaxial connector and the first radiating element may be varied in width. More particularly, the conductor may have one width for a distance up to a point $\lambda/4$ away from the radiating element and then taper to a greater width for the $\lambda/4$ distance. This $\lambda/4$ section is known as a matching quarter wavelength transformer section, and is easily provided in view of the construction of the antenna.

Figure 14:
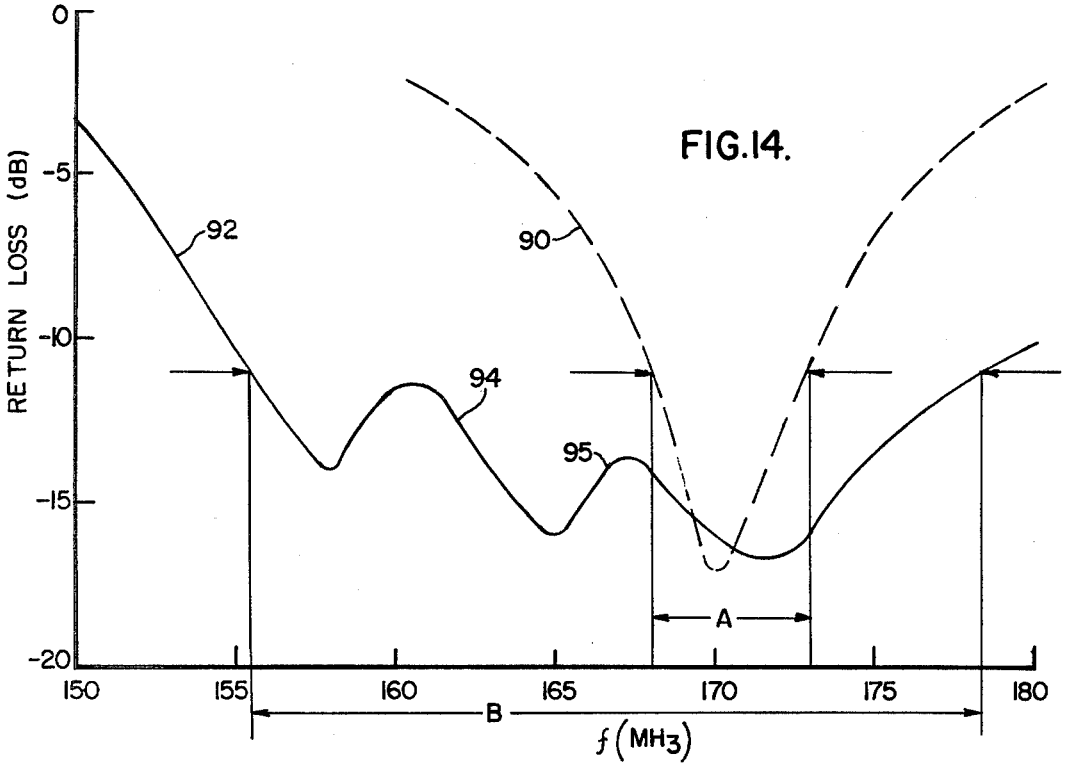
FIG. 14 are curves illustrating antenna return loss which is a measure of its impedance.

In FIG. 14 curves are presented to illustrate the difference in broad band operation achievable utilizing an array of radiating elements with a low impedance transmission line section between the elements. Frequency, in megahertz, is plotted on the horizontal axis and return loss in decibels is plotted on the vertical axis. Basically, the return loss provides an indication of the amount of energy reflected back from the terminal and thus not available for radiation. The more negative values are indicative of more efficient radiation. For example, at a value of −20 dB almost all of the input energy may be radiating out the antenna while at some arbitrarily chosen value, such as −11 dB, although not as much of the energy is radiated, satisfactory operation still obtains.

The dotted curve 90 in FIG. 14 is a plot utilizing a single radiating element as described herein, however with discrete wires sandwiched between insulating layers, in place of flat laminated copper conductors. It is seen that at the arbitrarily chosen −11 dB point, the return loss at this value extends over a frequency range designated A. Solid curve 92 is a plot for an antenna array of two radiating elements as described herein with different impedance characteristics between sections as discussed with respect to FIG. 13. This particular curve is for two 22 ohm dipole pair elements on a 50 ohm line without a matching transformer section. Although curve 92 includes a plurality of humps 94 and 95, at the same arbitrarily chosen −11 dB value, the bandwidth is much greater than was the case with respect to curve 90, due to the specific tailoring of transformer sections, this greatly increased bandwidth being designated by the letter B. If a matching quarter wavelength transformer section were provided it would have the effect of lowering the return loss even further.

Figure 5A:
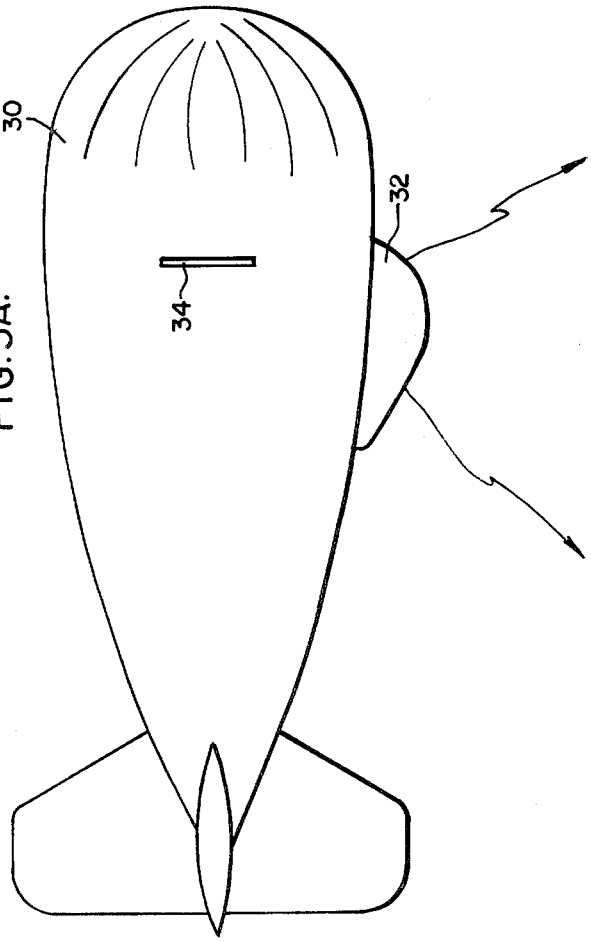
Figure 15:
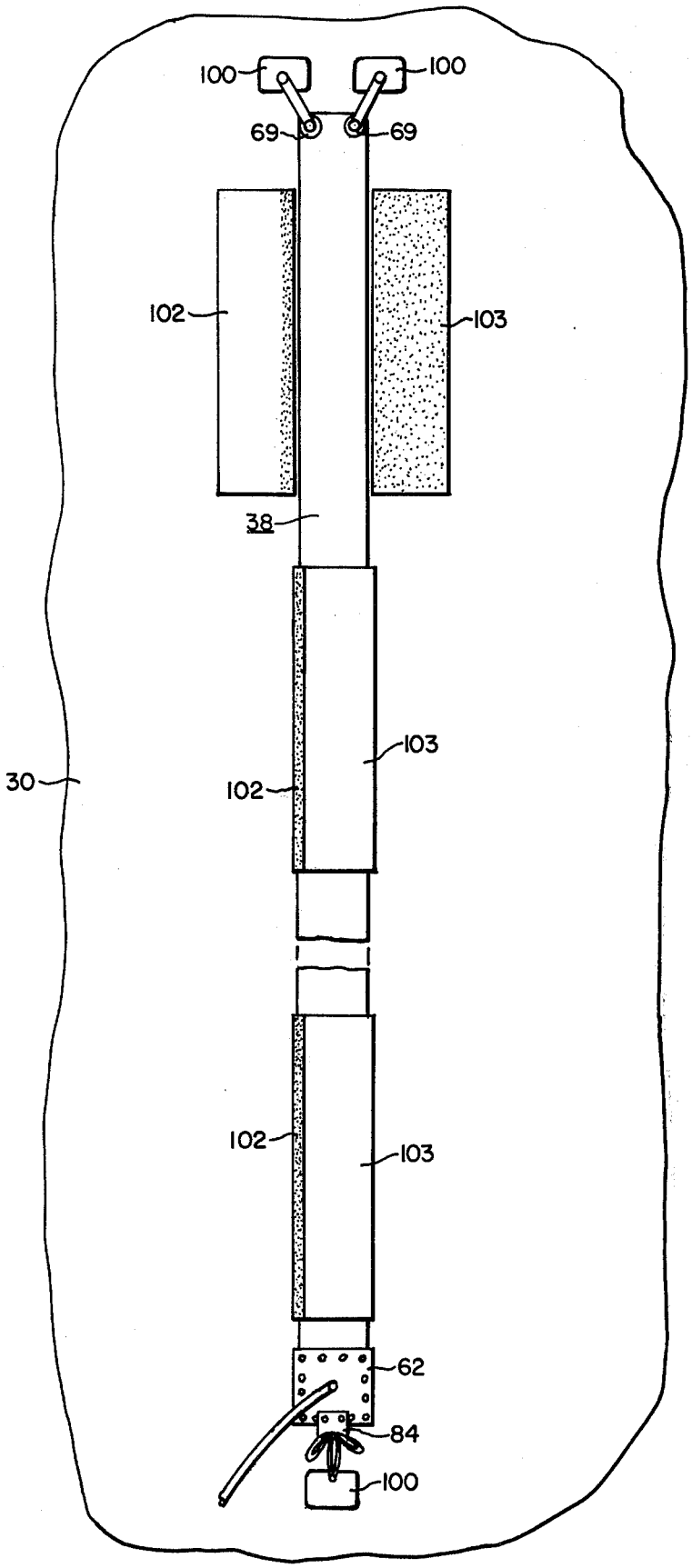
FIG. 15 illustrates the antenna in position on the skin of an aerostat.

FIG. 15 illustrates the flexible strap-like antenna 38 as it may be secured to the skin of an aerostat 30 such as illustrated in FIGS. 5A and 5B. Adhesively secured to the skin is a plurality of pads 100 each including a loop so that the antenna 38 may be tied in place by means of reinforced eyelets 69 and lacing lug 84. To further restrict movement of the antenna, a plurality of flaps are provided each including a flap section 102 and 103 adhesively secured to the skin of the aerostat. As illustrated in FIG. 15 by the topmost flap arrangement, flap 102 may be folded over the antenna and flap 103 thereafter folded over flap 102. A commonly available fastening arrangement such as complementary hook and loop fasteners known by the trade name Velcro may be utilized to secure the arrangement.

Accordingly, there has been described a flexible antenna which may be easily mounted on the outside surface of a tethered aerostat. The antenna is of such construction as to not materially add significant weight to the payload. Although the antenna has been described in this embodiment by way of example, it will be apparent that the antenna could be utilized in other environments and for other communication systems.

We claim:

1. A flexible lightweight dipole antenna comprising:

(A) an elongated flexible substrate member;

(B) a layer of electrically conductive material disposed over said substrate member in a predetermined pattern which includes a first conductor extending along the length of said substrate member, and first and second dipole antenna elements respectively disposed on either side of, and connected to, said first conductor and defining a first radiating and/or receiving element;

(C) a flexible, electrically insulating layer disposed over said first conductor;

(D) a second conductor positioned over said insulation layer and having a width which is less than the distance between said first and second dipole antenna elements;

(E) an elongated flexible covering layer covering said second conductor; and (F) a connector assembly for signal transfer with said antenna, connected to said first and second conductors.

2. Apparatus according to claim 1 which includes (A) at least one other pair of dipole antenna elements, defined by said electrically conductive material, respectively disposed on either side of, and connected to, said first conductor and defining a second radiating and/or receiving element.

3. Apparatus according to claim 2 wherein (A) said second radiating and/or receiving element is disposed at a distance of approximately $\lambda$ from said first radiating and/or receiving element, where $\lambda$ is the center operating wavelength.

4. Apparatus according to claim 2 wherein (A) the impedance $Z_1$ between said connector assembly and said first radiating and/or receiving element is different than the impedance $Z_2$ between said first radiating and/or receiving element and said second radiating and/or receiving element.

5. Apparatus according to claim 4 wherein (A) the average width of said first conductor between said connector assembly and said first radiating and/or receiving element is different than the average width of said first conductor between said first radiating and/or receiving element and said second radiating and/or receiving element.

6. Apparatus according to claim 4 wherein (A) $Z_1 > Z_2$.

7. Apparatus according to claim 1 wherein (A) said electrically conductive material is flat and bonded to said substrate member.

8. Apparatus according to claim 1 wherein (A) said second conductor is flat and bonded to said covering layer.

9. Apparatus according to claim 1 wherein (A) said first conductor extends down the middle of said substrate member.

10. Apparatus according to claim 9 wherein (A) said second conductor extends down the middle of said covering layer and is coextensive with said first conductor.

11. Apparatus according to claim 1 wherein (A) said electrically insulating layer is a strip, the width of which is greater than the width of said first conductor but less than the width of said substrate member.

12. Apparatus according to claim 2 wherein (A) said first conductor between said connector assembly and said first radiating and/or receiving element is of a length L and said first and second conductors extend past said second radiating and/or receiving element for a distance L.

13. Apparatus according to claim 1 wherein (A) said first conductor is electrically joined with said second conductor by physical contact therewith at one position along the length thereof.

14. Apparatus according to claim 1 wherein said connector assembly includes (A) a connector plate;

(B) a backing plate;

(C) a coaxial connector centrally disposed relative to said connector plate;

(D) said connector plate and said backing plate being joined together with said substrate member, first and second conductors, electrically insulating layer and said covering layer being sandwiched therebetween.

15. Apparatus according to claim 1 wherein said substrate member and covering layer include (A) reinforcced eyelets therein for lacing attachment with a support structure.

* * * * *